US009352592B2

(12) United States Patent
Anzai

(10) Patent No.: US 9,352,592 B2
(45) Date of Patent: May 31, 2016

(54) LIQUID DISCHARGING APPARATUS

(71) Applicant: SEIKO EPSON CORPORATION, Tokyo (JP)

(72) Inventor: Sumito Anzai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/923,010

(22) Filed: Oct. 26, 2015

(65) Prior Publication Data

US 2016/0114604 A1 Apr. 28, 2016

(30) Foreign Application Priority Data

Oct. 28, 2014 (JP) ..... 2014-219028

(51) Int. Cl.
*B41J 29/393* (2006.01)
*B41J 13/00* (2006.01)

(52) U.S. Cl.
CPC ..... *B41J 13/0009* (2013.01)

(58) Field of Classification Search
CPC ..... B41J 29/393; B41J 2/125; B41J 2/0451; B41J 13/0027; B41J 11/009; B41J 2/14153; B41J 11/42; B41J 2/04505; B41J 19/205; B41J 19/142
See application file for complete search history.

(56) References Cited

U.S. PATENT DOCUMENTS 8,235,492 B2 * 8/2012 Saito ..... B41J 11/42 347/16
8,989,648 B2 * 3/2015 Koyama ..... B41J 13/0045 270/32
9,022,511 B2 * 5/2015 Mizutani ..... B41J 11/002 347/102
2004/0179047 A1 9/2004 Niimi

FOREIGN PATENT DOCUMENTS

JP 2004-268506 9/2004
JP 2005-045644 2/2005

* cited by examiner

*Primary Examiner* — Lamson Nguyen
(74) *Attorney, Agent, or Firm* — Workman Nydegger

(57) ABSTRACT

A liquid discharging apparatus includes a discharge unit capable of discharging a liquid to a discharge region, a medium movement unit capable of moving in movement directions while supporting a medium onto which the liquid is discharged, a base unit that constitutes a movement path along which the medium movement unit moves, a detected unit, and a detector unit capable of detecting a position of the medium movement unit by detecting the detected unit. The detected unit and the detector unit are disposed so that the detected unit is detected by the detector unit when the medium movement unit is at a protrusion position at which a one direction-side end portion of the medium movement unit which is at a one direction side in the movement directions protrudes more toward the one direction side than does a one direction-side end portion of the base unit.

10 Claims, 6 Drawing Sheets

LIQUID DISCHARGING APPARATUS

BACKGROUND

1. Technical Field

The present invention relates to a liquid discharging apparatus.

2. Related Art

Liquid discharging apparatuses (ink jet type textile printing apparatuses) that print (pressure print) desired images on surface of a cloth of, for example, a T-shirt, by discharging various color inks from ink discharging heads have been widely used. For example, JP-A-2004-268506 describes a liquid discharging apparatus (ink jet type cloth printing apparatus) which includes a medium movement unit on which a cloth is set and in which when the power supply of the apparatus is off, the medium movement unit is positioned so as to be housed within an apparatus body, and when a cloth is set on the medium movement unit or removed from the medium movement, the medium movement unit is positioned so as to partially protrude from the apparatus body to one side, and when a printing operation is performed on the cloth, the medium movement unit is controlled so as to move from a position at which the medium movement unit partially protrudes from the apparatus body to the one side to a position at which the medium movement unit partially protrudes from the apparatus body to another side and then return to the position at which the medium movement unit partially protrudes to the one side.

However, a cloth printing apparatus whose medium movement unit is movable as described above sometimes falls into an undesirable situation where when the medium movement unit is at such a position as to partially protrude from the apparatus body to one side, the medium movement unit is out of the detection range of a sensor or the like and, therefore, the position of the medium movement unit cannot be detected.

SUMMARY

An advantage of some aspects of the invention is that the incidence of a long waiting time due to the above-described situation is reduced.

A liquid discharging apparatus according an aspect of the invention includes a discharge unit capable of discharging a liquid to a discharge region, a medium movement unit capable of moving in movement directions while supporting a medium onto which the liquid is discharged, a base unit that constitutes a movement path along which the medium movement unit moves, a detected unit, and a detector unit capable of detecting a position of the medium movement unit by detecting the detected unit. The detected unit and the detector unit are disposed so that the detected unit is detected by the detector unit when the medium movement unit is at a protrusion position at which a one direction-side end portion of the medium movement unit which is at a one direction side in the movement directions protrudes more to the one direction side than does a one direction-side end portion of the base unit.

According to this aspect of the invention, when the medium movement unit is at the position at which the medium movement unit protrudes compared with the base unit, the liquid discharging apparatus detects the position of the medium movement unit.

In the liquid discharging apparatus according to the foregoing aspect, the detected unit and the detector unit may be disposed so that the detected unit is detected by the detector unit when the medium movement unit is in a range between the protrusion position and a predetermined position at which the one direction-side end portion of the medium movement unit is a predetermined distance apart from the one direction-side end portion of the base unit to an another direction side in the movement directions.

According to this construction, the liquid discharging apparatus is able to detect the position of the medium movement unit when the medium movement unit is in the range between the protrusion position and the predetermined position.

In the foregoing liquid discharging apparatus, the detected unit and the detector unit may be disposed so that when the medium movement unit is at a position that is more to the another direction side than the predetermined position, the detected unit is not detected by the detector unit.

According to this construction, when the medium movement unit is at a position that is more to the another direction side than is the predetermined position, the liquid discharging apparatus is able to detect that state. More specifically, based on a result of detection by the detector unit (information that the detected unit is not detected by the detector unit), the liquid discharging apparatus is able to detect that the medium movement unit is more to the another direction side in the movement directions of the medium movement unit than is the predetermined position.

In the foregoing liquid discharging apparatus, the discharge unit may be disposed so as to be more to the another direction side than the medium movement unit when the medium movement unit is positioned at the protrusion position, and the predetermined position may be a position at which an another direction-side end portion of the medium movement unit reaches the discharge region.

According to this construction, the liquid discharging apparatus is able to detect the position of the medium movement unit when the medium movement unit is in the range between the protrusion position and the position at which the another direction-side end portion of the medium movement unit reaches the discharge region.

The liquid discharging apparatus described above may further include an interfering object detection unit that detects whether or not an interfering object that interferes with the discharge unit when the medium movement unit moves is present on or at the medium movement unit. The interfering object detection unit may be disposed so as to be more to the another direction side than the medium movement unit when the medium movement unit is positioned at the protrusion position, and the predetermined position may be a position at which an another direction-side end portion of the medium movement unit reaches a detection region in which the interfering object detection unit is able to detect the interfering object.

According to this construction, the liquid discharging apparatus is able to detect the position of the medium movement unit when the medium movement unit is in the range between the protrusion position and the position at which the another direction-side end portion of the medium movement unit reaches the detection region in which the interfering object detection unit is able to detect the interfering object.

The liquid discharging apparatus described above may further include a control unit that, when having accepted a predetermined instruction, causes the detector unit to execute a detection operation for detecting the detected unit.

According to this construction, the liquid discharging apparatus is able to cause the detection operation to be carried out appropriately according to whether the detection operation has been requested.

In the foregoing liquid discharging apparatus, if the predetermined instruction is an instruction to turn on a power supply of the liquid discharging apparatus, the control unit may cause the detector unit to execute the detection operation, and if the detector unit detects the detected unit, the control unit may avoid causing the medium movement unit to move.

According to this construction, if the detector unit detects the detected unit when the power supply of the liquid discharging apparatus is turned on, the liquid discharging apparatus is able to determine that the medium movement unit is at an appropriate position and thus to omit a position alignment operation for the medium movement unit.

In the liquid discharging apparatus described above, if the predetermined instruction is a print start instruction to start a printing operation that discharges the liquid onto the medium, the control unit may cause the detector unit to execute the detection operation, and if the detector unit detects the detected unit, the control unit may cause the medium movement unit to move to a print start position at which the printing operation starts.

According to this construction, the liquid discharging apparatus can check that the medium movement unit is at an appropriate position, before starting the printing operation.

In the liquid discharging apparatus described above, if the predetermined instruction is an instruction to turn off a power supply of the liquid discharging apparatus, the control unit may cause the detector unit to execute the detection operation, and if the detector unit detects the detected unit, the control unit may turn off the power supply.

According to this construction, the liquid discharging apparatus can check that the medium movement unit is at an appropriate position, before turning off the power supply.

In the liquid discharging apparatus described above, the control unit may cause the detector unit to execute the detection operation, and if the detector unit does not detect the detected unit, the control unit may cause the medium movement unit to move to the protrusion position.

According to this construction, when the position of the medium movement unit cannot be detected, the liquid discharging apparatus is able to move the position of the medium movement unit to a position at which the position of the medium movement unit can be detected.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
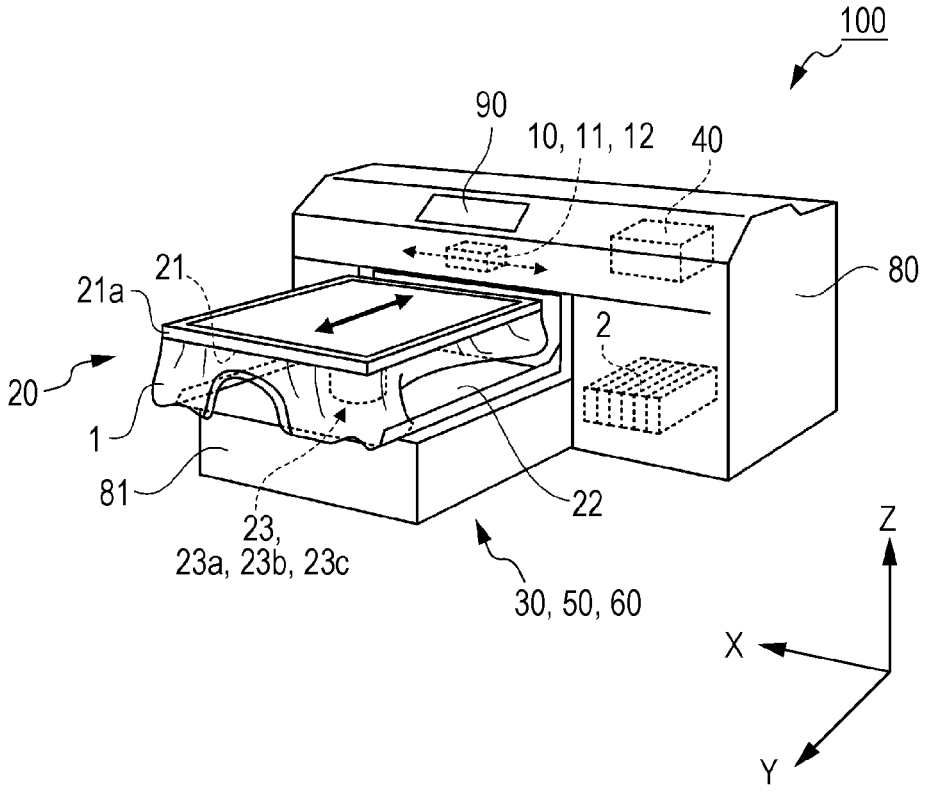
FIG. 1 is a perspective view of an ink jet type printer as a liquid discharging apparatus according to Exemplary Embodiment 1 of the invention.

Hereinafter, exemplary embodiments of the invention will be described with reference to the accompanying drawings. While an exemplary embodiment of the invention will be mainly described below, the exemplary embodiment does not limit the scope of the invention. Incidentally, in the drawings referred to below, the scale of illustration may be different from the actual scale for the sake of facilitating the illustration. As for coordinate systems indicated in the drawings, it is reached that the Z-axis directions are upward/downward directions, the +Z direction is an upward direction, the Y-axis directions are forward/rearward directions, the +Y direction is a forward direction, the X-axis directions are leftward/rightward directions, the +X direction is a leftward direction, and an X-Y plane is a horizontal plane.

Exemplary Embodiment 1

Figure 2:
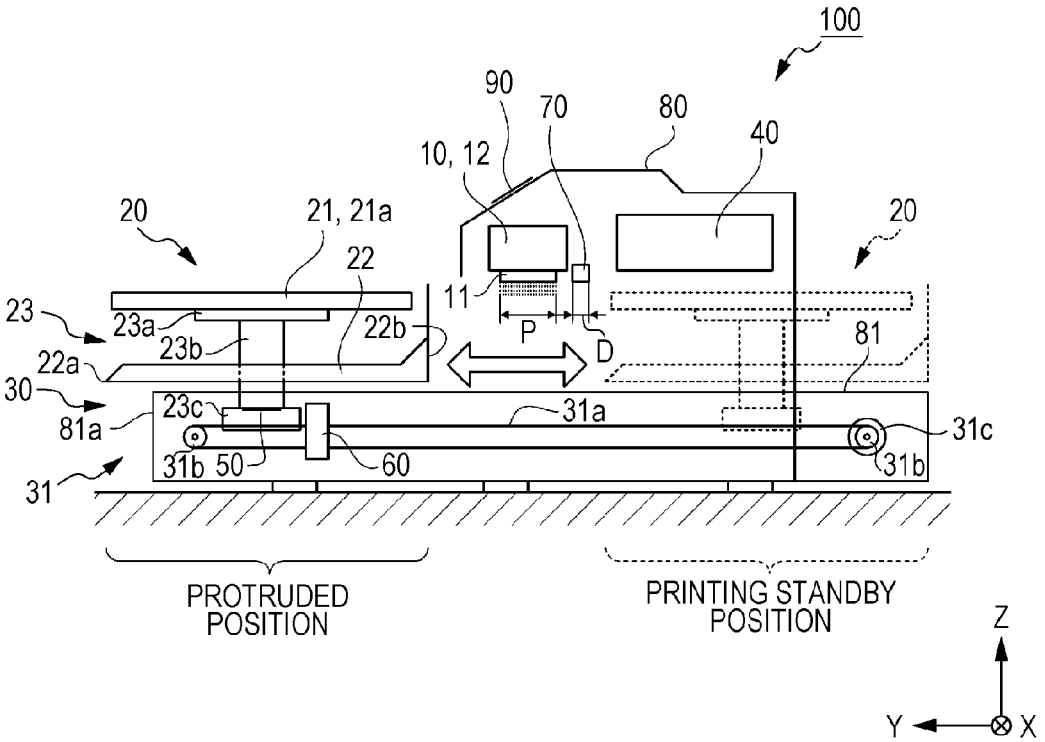
FIG. 2 is a side view of an ink jet type printer.

FIG. 1 is a perspective view illustrating a general construction of an ink jet type printer 100 (hereinafter, referred to as "printer 100") as an example of a liquid discharging apparatus according to Exemplary Embodiment 1. FIG. 2 is a side view of the printer 100.

The printer 100 is an ink jet type of textile printing apparatus (printer apparatus) that prints (pressure prints) desired images on a cloth as a medium (e.g., a T-shirt 1 shown in FIG. 1) by discharging ink as an example of a liquid. However, the printer 100 may also be a printer apparatus that performs printing by using a medium other than cloth. Various media can be used, including paper, films, three-dimensional bodies, etc.

The printer 100 includes a discharge unit 10, a medium movement unit 20, a base unit 30, a control unit 40, a detected unit 50, a detector unit 60, an interfering object detection unit 70 (depicted in FIG. 2).

The discharge unit 10 is a portion that forms an image on a surface of a cloth by discharging ink onto the cloth. The discharge unit 10 includes a discharging head 11, a carriage 12, etc. The discharging head 11, based on control by the control unit 40, discharges ink supplied from an ink cartridge 2 through a tube or the like to a discharge region P (see FIG. 2). The carriage 12, having the discharging head 11 mounted thereof, moves the discharging head 11 back and forth in scanning directions (X-axis directions) by using a scanning mechanism (not depicted) based on control by the control unit 40. To summarize, the liquid discharging apparatus has in the discharge region P the discharge unit 10 capable of discharging liquid to the discharge region P.

The medium movement unit 20 supports a cloth and moves to the discharge region P of the discharge unit 10 by a transporting mechanism 31 (described later) that the base unit 30 has. That is, the liquid discharging apparatus includes the medium movement unit 20 capable of supporting a medium to which liquid is discharged and capable of moving in movement directions. The printer 100 forms a desired image on a surface of a cloth by alternately repeating an action of the discharging head 11 moving back and forth in the scanning directions (X-axis directions) while discharging ink and a movement of the medium movement unit 20 in a direction (−Y direction) that intersects the scanning directions (X-axis directions) based on control by the control unit 40.

The medium movement unit 20 is constructed of a set tray 21, a table 22, a support member 23, etc.

The set tray 21 is a flat plate that supports a cloth on its upper surface, and supports the cloth in the form of a flat plane by using a frame 21*a* (depicted in FIG. 1).

The table 22 is a plane table that is disposed below the set tray 21 and is slightly wider than the set tray 21. Between the set tray 21 and the table 22, a cloth can be mounted using the frame 21*a*, while outer peripheral portions of a print surface surrounded by the frame 21*a* are folded or rolled and tucked in. The table 22 has side plates on left, right and rear sides within which a cloth is protected.

The support member 23 is constructed of a mount table 23*a*, a supporting column 23*b*, a connecting member 23*c*, etc. The mount table 23*a* is fixed to an upper portion of the supporting column 23*b* and is capable of fixing and supporting the set tray 21 horizontally (in parallel with a floor surface on which the printer 100 is installed) in a replaceable manner.

The supporting column 23*b* is fixed to the connecting member 23*c*, and fixes and supports the table 22 above the connecting member 23*c* and the mount table 23*a* even above the table 22. Furthermore, the supporting column 23*b* is provided with a height adjustment mechanism (not depicted) that adjust the height position of the printing plane (a surface of a cloth), that is, the height position of the mount table 23*a*, in accordance with the thickness of the cloth or the like.

The connecting member 23*c* connects the supporting column 23*b* to the transporting mechanism 31 of the base unit 30 and, on a movement path on which the medium movement unit 20 moves, supports the supporting column 23*b* so that the set tray 21 is kept horizontal.

The base unit 30 includes the transporting mechanism 31 and constitutes the movement path on which the medium movement unit 20 moves. The transporting mechanism 31 is constructed of a plurality of component parts that include a transport belt 31*a*, pulleys 31*b*, a transport motor 31*c*, etc. As the transport motor 31*c* is driven based on control by the control unit 40, the transport belt 31*a* is turned, so that the medium movement unit 20 connected to the transport belt 31*a* moves.

The movement path that the base unit 30 constitutes is constructed so that the medium movement unit 20 can be moved in movement directions (Y-axis directions) over a range between a position at which a user can set a cloth on (or remove a cloth from) the medium movement unit 20 and a print start position to start formation of an image on the set cloth. Furthermore, the movement path that the base unit 30 constitutes is constructed so that the medium movement unit 20 can be moved in the movement directions (Y-axis directions) over a range to a position (maintenance position) at which the medium movement unit 20 needs to be positioned in order to form a space needed for maintenance of the printer 100. That is, the base unit 30 extends so that sufficiently long movement paths are formed forward (in the +Y direction) and rearward (in the −Y direction) from a main body of the printer 100 (a casing 80 that does not include base unit 30). Furthermore, an outer periphery of the base unit 30 is surrounded by a base unit casing 81. To summarize, the liquid discharging apparatus includes the base unit 30 that constitutes the movement path on which the medium movement unit 20 moves.

Incidentally, since the upper surface of the set tray 21 functions as a platen that supports a medium, the movement path of the medium movement unit 20 is configured so that in the discharge region P, the distance in the height direction between the upper surface of the set tray 21 and the discharging head 11 is kept at a predetermined distance when the medium movement unit 20 moves.

The interfering object detection unit 70 has a function of detecting whether or not an interfering object that interferes with the discharge unit 10 (discharging head 11) when the medium movement unit 20 moves is present on or at medium movement unit 20. That is, the liquid discharging apparatus includes the interfering object detection unit 70 that detects whether the medium movement unit 20 has an interfering object that interferes with the discharge unit 10 when the medium movement unit 20 moves. For example, the case where a cloth set on the upper surface of the set tray 21 is partially floating above the upper surface of the set tray 21, the case where a tag or the like attached to a cloth is higher than the upper surface of the set tray 21, or the like sometimes results in interference with the discharging head 11 during printing. The interfering object detection unit 70 detects in advance possible interference, stops movement of the medium movement unit 20, and produces an alert or the like to reduce the possibility of damaging the discharging head 11 or a cloth due to such interference.

The interfering object detection unit 70, concretely, is constructed of, for example, an optical sensor that has a light emitting portion and a light receiving portion. The presence or absence of an interfering object is detected by this optical sensor when the medium movement unit 20 is at a position preceding a region under a movement range of the discharging head 11. As shown in FIG. 2, the interfering object detection unit 70 is provided at the rear (−Y direction side) of the discharge unit 10. A region in the Y-axis directions in which the interfering object detection unit 70 can detect the presence or absence of an interfering object is a interfering object detection region D indicated in FIG. 2.

In the movement range of the medium movement unit 20, a position at which a cloth can be set on (or removed from) the medium movement unit 20 is a position at which the medium movement unit 20 is sufficiently drawn out from the casing 80. This will be concretely described with reference to FIG. 2. A state in which a one direction-side end portion of the medium movement unit 20 that is at a side in one direction of the movement directions of the medium movement unit 20 (a +Y direction-side end portion thereof) (concretely, a +Y direction-side end portion 22*a* of the table 22) protrudes more to the one direction side (+Y direction side) than does a one direction-side (+Y direction-side) end portion of the base unit 30 (concretely, a +Y direction-side end surface 81*a* of the base unit casing 81) is termed as being at a "protrusion position" of the medium movement unit 20. In a range on the Y axis from the protrusion position to a position of the medium movement unit 20 at which an other direction-side (−Y direction-side) end portion of the medium movement unit 20 (concretely, a −Y direction-side end surface 22*b*) of the table 22) is in the discharge region P, a cloth can be set on (removed from) the medium movement unit 20. In other words, the medium movement unit 20 and the base unit 30 are constructed so as to have the above-described positional relation. This can also be described as follows. The detected unit 50 and the detector unit 60 are disposed so that the detected unit 50 is detected by the detector unit 60 when the medium movement unit 20 is at the protrusion position. As a result, when the medium movement unit 20 is at a position at which the medium movement unit 20 protrudes from the base unit 30, the position of the medium movement unit 20 can be detected.

Incidentally, the end portion of the medium movement unit 20 at the side in the one direction of the movement directions of the medium movement unit 20 (the +Y direction-side end portion thereof) may be defined as being a +Y direction-side end portion of the set tray 21. Furthermore, the other direction-side (−Y direction-side) end portion of the medium movement unit 20 may also be defined as being a −Y direction-side end portion of the set tray 21.

A print start position, one of the positions to which the medium movement unit 20 is movable, is a position reached when the medium movement unit 20, after a cloth has been set thereon, moves in the −Y direction until the set tray 21 passes through the discharge region P and the interfering object detection region D. That is, when printing is to be performed, the medium movement unit 20 is moved to the print start position, passing through the discharge region P and the interfering object detection region D, and then is moved back toward the +Y direction side to enter the discharge region P, where a printing operation is executed. Prior to printing, when the medium movement unit 20 passes through the discharge region P, the discharging head 11 has been moved by a scanning mechanism to a home position that is outside a region on the X axis through which the medium movement unit 20 passes (that is at the −X direction side or the +X direction side). The interfering object detection unit 70 detects the presence or absence of an interfering object when the medium movement unit 20 passes through the interfering object detection region D. That is, the presence or absence of an interfering object is detected when the medium movement unit 20 moves to the print start position and the medium movement unit 20 re-enters the discharge region P.

A maintenance position, one of the positions to which the medium movement unit 20 can move, is a position that the medium movement unit 20 assumes after further moving in the −Y direction from the position where the set tray 21 has passed through the discharge region P. At the maintenance position, a space needed for maintenance of the discharge unit 10 (e.g., the cleaning of the discharging head 11 and adjustment of the scanning mechanism) is formed. Therefore, to perform the maintenance of the printer 100, the medium movement unit 20 is moved to the maintenance position, so that maintenance operations can be easily performed.

When printing is to be performed, the power supply of the printer 100 is first turned on. If at this time, the medium movement unit 20 is not at a position that allows a cloth to be set, the printer 100 moves the medium movement unit 20 to the protrusion position. After a user sets a cloth on the medium movement unit 20 and inputs a print start instruction, the medium movement unit 20 moves in the −Y direction to the print start position, passing through the discharge region P and the interfering object detection region D, and then moves back in the +Y direction and enters the discharge region P, where the printing operation is executed.

After the printing ends, the printer 100 moves the medium movement unit 20 to the protrusion position. Then, the user removes the cloth from the medium movement unit 20 and sets a new cloth to be subjected to printing. After the necessary printing on cloths ends, the user performs an operation of turning off the power supply of the printer 100. Then, if the medium movement unit 20 is not at a position that allows a cloth to be set, the printer 100 moves the medium movement unit 20 to the protrusion position. After that, the printer 100 turns off the power supply.

Note that the instruction to start printing and the like can be input via an operation panel 90 that is provided on an upper portion of a front surface of the casing 80.

Figure 3:
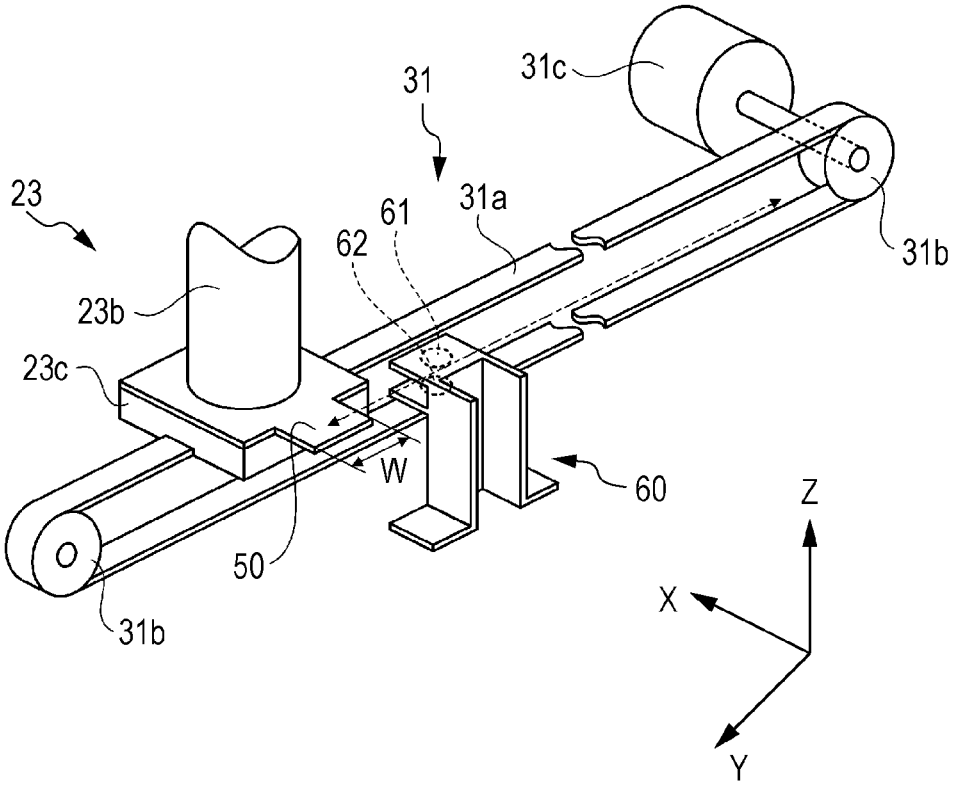
FIG. 3 is a perspective view illustrating a construction of a detected unit and a detector unit.

FIG. 3 is a perspective view illustrating a construction of the detected unit 50 and the detector unit 60.

As described above, an operation of moving the medium movement unit 20 is needed depending on the position of the medium movement unit 20. Therefore, the printer 100 includes the detected unit 50 and the detector unit 60 as a device that detects the position of the medium movement unit 20. The detector unit 60 is able to detect the position of the medium movement unit 20 relative to the base unit 30 by detecting the detected unit 50. In other words, the detector unit 60 is a detector unit capable of detecting the position of the medium movement unit 20 by detecting the detected unit 50.

The detector unit 60 includes a light emitting element 61 and a light receiving element 62 that face each other. When an optical path of detection light that the light emitting element 61 emits and that the light receiving element 62 receives is blocked by a light blocker, the detector unit 60 detects a change in the amount of light received by the light receiving element 62. In this manner, the detector unit 60 can detect the presence or absence of the light blocker.

The detected unit 50 is constituted by the light blocker that enters a detection region of the detector unit 60 and blocks light. Specifically, the detector unit 60 is disposed at a predetermined position on the base unit 30 and the detected unit 50 is disposed at a predetermined position on the medium movement unit 20 so that as the medium movement unit 20 moves, the detected unit 50 enters the detection region of the detector unit 60. Therefore, the position of the medium movement unit 20 relative to the base unit 30 can be detected.

In this exemplary embodiment, as shown in FIG. 3, the detected unit 50 is formed by an extended portion of a top plate of the connecting member 23*c*. Concretely, the detected unit 50 is formed by a rectangular plate that has a width W in the Y-axis directions and that extends in the −X direction from the connecting member 23*c*. As the connecting member 23*c* is moved in the Y-axis directions, the rectangular plate passes through the detection region of the detector unit 60 (a space between the light emitting element 61 and the light receiving element 62 facing each other).

Incidentally, a construction in which the detector unit 60 is disposed at a predetermined position on the medium movement unit 20 and the detected unit 50 is disposed at a predetermined position on the base unit 30 may also be adopted.

Figure 4:
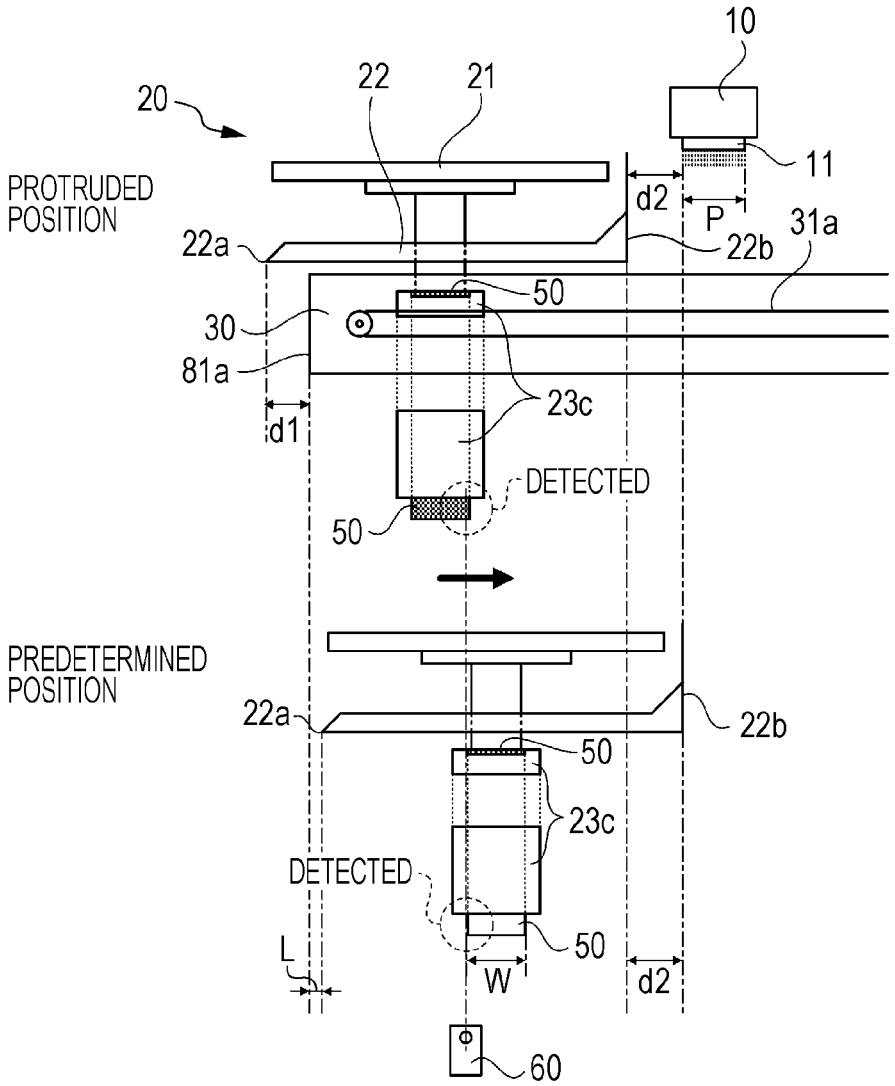
FIG. 4 is an illustrative diagram illustrating positions at which the detected unit and the detector unit are set.

FIG. 4 is an illustrative diagram illustrating positions (positions on the Y axis) at which the detected unit 50 and the detector unit 60 are disposed. For the sake of easy understanding, the connecting member 23*c* and the detected unit 50 are shown in both a side view and a plan view for each of the two positions. In FIG. 4, the uppermost diagram is a side view where the medium movement unit 20 is at the protrusion position, the second diagram from the top is a plan view in which the medium movement unit 20 is at the protrusion position (in which the connecting member 23*c* and the like are selectively shown), the third diagram from the top is a side view where the medium movement unit 20 is at the predetermined position, and the fourth diagram from the top is a plan view in which the medium movement unit 20 is at the predetermined position (in which the connecting member 23*c* and the like are selectively shown).

The detected unit 50 and the detector unit 60 are disposed so that when the medium movement unit 20 is at the foregoing protrusion position, the detected unit 50 is detected by the detector unit 60.

The arrangement of the detected unit 50 and the detector unit 60 will be more concretely described with reference to FIG. 4. The detected unit 50 and the detector unit 60 are disposed so that when the medium movement unit 20 is at the protrusion position at which a one direction-side end portion of the medium movement unit 20 that is at the side in the one direction of the movement directions (at the +Y direction side) (i.e., the +Y direction-side end portion 22*a* of the table 22) protrudes more to the one direction side (+Y direction side) than does a one direction-side (+Y direction-side) end portion of the base unit 30 (i.e., the +Y direction-side end surface 81*a* of the base unit casing 81), the detected unit 50 is always detected by the detector unit 60. That is, the detected unit 50 and the detector unit 60 are disposed so that when the medium movement unit 20 is at the farthest position in the +Y direction to which the medium movement unit 20 can be moved (at the position at which an amount of protrusion d1 indicated in an upper portion of FIG. 4 is maximum), the detected unit 50 is within a detection region of the detector unit 60 indicated in a lower portion of FIG. 4.

Furthermore, the detected unit 50 and the detector unit 60 are disposed so that when the position of the medium movement unit 20, more concretely, the position of the one direction-side end portion of the medium movement unit 20 that is at the side in the one direction of the movement directions (at the +Y direction side) (i.e., the +Y direction-side end portion 22*a* of the table 22), is in a range between the protrusion position and a position reached by a slight movement from the protrusion position to the other direction side (−Y direction side) (i.e., reached by a slight push-in), the detected unit 50 is detected by the detector unit 60.

The "position reached by a slight movement from the protrusion position to the other direction side (−Y direction side) (i.e., reached by a slight push-in)" will be described. First, a position at which the one direction-side end portion of the medium movement unit 20 that is at the side in the one direction of the movement directions (at the +Y direction side) (i.e., the +Y direction-side end portion 22*a* of the table 22) is a predetermined distance L apart in the other direction of the movement directions from the one direction-side end portion of the base unit 30 (the end surface 81*a* thereof) is termed the "predetermined position". Then, the "position reached by a slight movement from the protrusion position to the other direction side (−Y direction side) (i.e., reached by a slight push-in)" is a position where the medium movement unit 20 reaches the predetermined position.

An example of the predetermined position is a position where, as shown in a lower portion of FIG. 4, an other direction-side (−Y direction-side) end portion of the medium movement unit 20 (a −Y direction-side end surface 22*b* of the table 22) reaches the discharge region P.

The width W of the detected unit 50 in the Y-axis directions and the detection region of the detector unit 60 are set so that the detected unit 50 is detected by the detector unit 60 when the medium movement unit 20 is within a range between the position at which the amount of protrusion d1 toward the +Y direction side is maximum and the predetermined position reached by a slight movement from the position of the maximum amount of protrusion d1 to the other direction side (−Y direction side) (i.e., reached by a slight push-in). This range is a range where the −Y direction-side end surface 22*b* of the table 22 is moved over a range of d2 indicated in FIG. 4, that is, a range where the detector unit 60 detects that the medium movement unit 20 is at a position that allows a cloth to be set. In other words, the detected unit 50 and the detector unit 60 are disposed so that the detected unit 50 is detected by the detector unit 60 when the medium movement unit 20 is in the range between the protrusion position and the predetermined position. In this exemplary embodiment, the discharge unit 10 is disposed so as to be more to the other direction side than the medium movement unit 20 when the medium movement unit 20 is positioned at the protrusion position. Then, the predetermined position is a position at which the other direction-side end portion of the medium movement unit 20 reaches the discharge region P.

Furthermore, the detected unit 50 and the detector unit 60 are disposed so that the detected unit 50 is not detected by the detector unit 60 when the one direction-side end portion of the medium movement unit 20 that is at the side in the one direction of the movement directions (at the +Y direction side) (i.e., the +Y direction-side end portion 22*a* of the table 22) is at a position that is more to the other direction side (−Y direction side) than the predetermined position. That is, the width W of the detected unit 50 in the Y-axis directions and the detection region of the detector unit 60 are set so that when the medium movement unit 20 moves to the other direction side (−Y direction side) of the predetermined position, the detected unit 50 is out of the detection region of the detector unit 60. In other words, the detected unit 50 and the detector unit 60 are disposed so that when medium movement unit 20 is at a position that is more to the other direction side than the predetermined position, the detected unit 50 is not detected by the detector unit 60.

The control unit 40 includes a CPU (computation portion) and storage units such as a RAM and a ROM (not depicted), and performs centralized control of the entire printer 100, including the discharge unit 10, the medium movement unit 20, the base unit 30, the detected unit 50, the detector unit 60, the interfering object detection unit 70, etc., based on software on which the control unit 40 operates.

The operation panel 90 includes a display and an input unit and allows a user to input an instruction to the control unit 40 or to perform selection.

An operation of the detector unit 60 for detecting the detected unit 50 is performed based on a control performed by the control unit 40 in response to a predetermined instruction. In other words, the liquid discharging apparatus includes the control unit 40 that, when having accepting a predetermined instruction, causes the detector unit 60 to execute a detection operation for detecting the detected unit 50. The control unit 40 is configured to cause the detector unit 60 to execute the detection operation and to cause the medium movement unit 20 to be moved to the protrusion position if the detector unit 60 does not detect the detected unit 50. Incidentally, examples of the predetermined instruction include an instruction to turn on the power supply of the printer 100, an instruction to turn off the power supply of the printer 100, the print start instruction to start a printing operation, etc. The printing operation is an operation of printing an image or the like on a medium by discharging liquid to the medium.

The control unit 40 receiving or accepting the instruction to turn on the power supply of the printer 100 means that the control unit 40 detects a state occurring when the user turns on the power supply of the printer 100. That is, when the control unit 40 has detected the turning-on of the power supply, the printer 100 detects the position of the medium movement unit 20 relative to the base unit 30. If at this time, the detector unit 60 detects the detected unit 50, the control unit 40 does not move the medium movement unit 20. If the detector unit 60 does not detect the detected unit 50, the control unit 40 moves the medium movement unit 20 to the protrusion position. After that, the control unit 40 once again executes the operation of the detector unit 60 for detecting the detected unit 50. To summarize, the control unit 40 is configured to cause the detector unit 60 to execute the detection operation if the predetermined instruction is the instruction to turn on the power supply of the liquid discharging apparatus and to avoid causing the medium movement unit 20 to be moved if the detector unit 60 detects the detected unit 50. Therefore, when the detector unit 60 detects the detected unit 50, the control unit 40 can determine that the medium movement unit 20 is at an appropriate position, so that a position alignment operation for the medium movement unit 20 can be omitted.

If the predetermined instruction is the instruction to turn off the power supply of the printer 100, the control unit 40 causes the detector unit 60 to execute the detection operation. Then, if the detector unit 60 detects the detected unit 50, the control unit 40 turns off the power supply of the printer 100. If the detector unit 60 does not detect the detected unit 50, the control unit 40 causes the medium movement unit 20 to be moved to the protrusion position. After that, the control unit 40 once again executes the operation of the detector unit 60 for detecting the detected unit 50. If the detector unit 60 detects the detected unit 50, the control unit 40 turns off the power supply of the printer 100. To summarize, the control unit 40 is configured to cause the detector unit 60 to execute the detection operation if the predetermined instruction is the instruction to turn off the power supply of the liquid discharging apparatus and to turn off the power supply if the detector unit 60 detects the detected unit 50. The control unit 40 can check that the medium movement unit 20 is at an appropriate position, before turning off the power supply of the liquid discharging apparatus.

If the predetermined instruction is the print start instruction to start a printing operation, the control unit 40 causes the detector unit 60 to execute the detection operation. Then, if the detector unit 60 detects the detected unit 50, the control unit 40 causes the medium movement unit 20 to be moved to the print start position. On the other hand, if the detector unit 60 does not detect the detected unit 50, the control unit 40 causes the medium movement unit 20 to be moved to the protrusion position. After that, the control unit 40 once again executes the operation of the detector unit 60 for detecting the detected unit 50. Then, if the detector unit 60 detects the detected unit 50, the control unit 40 causes the medium movement unit 20 to be moved to the protrusion position. To summarize, the control unit 40 is configured to cause the detector unit 60 to execute the detection operation if the predetermined instruction is the print start instruction to start the printing operation of discharging liquid droplets to a medium and to cause the medium movement unit 20 to be moved to the print start position at which to start the printing operation if the detector unit 60 detects the detected unit 50. Therefore, the control unit 40 can check that the medium movement unit 20 is at an appropriate position, before starting the printing operation.

As described above, the liquid discharging apparatus according to this exemplary embodiment can achieve the following advantageous effects.

The detected unit 50 and the detector unit 60 are disposed so that the detected unit 50 is detected by the detector unit 60 when the medium movement unit 20 is at the protrusion position where the one direction-side end portion of the medium movement unit 20 that is at the side in the one direction of the movement directions (at the +Y direction side) (i.e., the +Y direction-side end portion 22*a* of the table 22) protrudes more to the one direction-side (+Y direction-side) than does the one direction side (+Y direction side) end portion of the base unit 30 (the end surface 81*a* thereof). That is, when the medium movement unit 20 is at the position where the medium movement unit 20 protrudes compared with the base unit 30, that is, when the medium movement unit 20 is in a state where a cloth can be set on (or removed from) the medium movement unit 20, the printer 100 is able to detect that state based on a result of detection performed by the detector unit 60 (based on information that the detector unit 60 has detected the detected unit 50).

Furthermore, when the medium movement unit 20 is in the range between the protrusion position and the position (predetermined position) reached by a movement of a predetermined distance L from the protrusion position to the other direction side (−Y direction side), the printer 100 is able to detect that state. That is, the range in the movement directions of the medium movement unit 20 between the protrusion position and the predetermined position that is a predetermined distance apart from the protrusion position can be detected as a position of the medium movement unit 20 where a cloth can be set on (or removed from) the medium movement unit 20.

Furthermore, when the medium movement unit 20 is at a position that is more to the other direction side (−Y direction side) than the predetermined position, the printer 100 is able to detect that state. That is, based on a result of detection by the detector unit 60 (information that the detector unit 60 has not detected the detected unit 50), the range in the movement directions of the medium movement unit 20 which is more to the predetermined position than the other direction side (−Y direction side) can be detected as a position that does not allow a cloth to be set on (or removed from) the medium movement unit 20. Therefore, the printer 100 can be configured to move the medium movement unit 20 only when medium movement unit 20 needs to be moved.

Furthermore, the range of position of the medium movement unit 20 between the protrusion position and the position where the other direction-side (−Y direction-side) end portion of the medium movement unit 20 (i.e., the −Y direction-side end surface 22*b* of the table 22) reaches the discharge region P can be detected as a position that allows a cloth to be set on (or removed from) the medium movement unit 20.

Further, the control unit 40, when having accepted a predetermined instruction, causes the detector unit 60 to execute the detection operation for detecting the detected unit 50. That is, the control unit 40 can cause the detector unit 60 to perform the detection operation only when there is a need to detect whether the medium movement unit 20 needs to be moved.

Furthermore, when having accepted the instruction to turn on the power supply as the predetermined instruction, the control unit 40 causes the detector unit 60 to execute the detection operation for detecting the detected unit 50. That is, the printer 100 detects the position of the medium movement unit 20 relative to the base unit 30 when the control unit 40 has detected the turning-on of the power supply, and if the detector unit 60 detects the detected unit 50, the control unit 40 does not move the medium movement unit 20. Therefore, when the medium movement unit 20 is detected as being at the position that allows a cloth to be set on (or removed from) the medium movement unit 20, the printer 100 can enter a mode of prompting the user to set a cloth on (or remove a cloth from) the medium movement unit 20 without moving the medium movement unit 20, so that a waiting time before a cloth is allowed to be set (or removed) can be eliminated.

If when the power supply of the printer 100 is turned off the medium movement unit 20 is in a state where when the power supply is turned on again a cloth will be able to be set on the medium movement unit 20 without a need to perform an operation of drawing the medium movement unit 20 into the main body of the printer 100 or an operation returning the medium movement unit 20 to the home position, that state is detected, so that the mode of prompting the user to set a cloth on the medium movement unit 20 will be able to be started without a need to wait for a certain movement of the medium movement unit 20.

Furthermore, the control unit 40, when having accepted the print start instruction to start the printing operation as the predetermined instruction, causes the detector unit 60 to execute the detection operation for detecting the detected unit 50. That is, the printer 100 can be configured so that when having received the print start instruction, the printer 100 detects the position of the medium movement unit 20 relative to the base unit 30, and moves the medium movement unit 20 only when the medium movement unit 20 needs to be moved in order to start to print.

Furthermore, when having accepted as the predetermined instruction the instruction to turn off the power supply, the control unit 40 causes the detector unit 60 to execute the detection operation for detecting the detected unit 50. That is, the printer 100 can be configured so that when having received the instruction to turn off the power supply, the printer 100 detects the position of the medium movement unit 20 relative to the base unit 30, and moves the medium movement unit 20 only when the medium movement unit 20 needs to be moved in connection with the power-off instruction.

Furthermore, the printer 100 can be configured so as to move the medium movement unit 20 only when the detector unit 60 does not detect the detected unit 50, that is, only when the medium movement unit 20 is not in the range of position where a cloth can be set on (or removed from) the medium movement unit 20.

Incidentally, the invention is not limited to the foregoing exemplary embodiment, the foregoing exemplary embodiment can be changed or modified in various manners. Modifications will be described below. The same component parts and sites as those in the foregoing exemplary embodiment are denoted by the same reference numerals, and redundant descriptions will be avoided.

Modification 1

Figure 5:
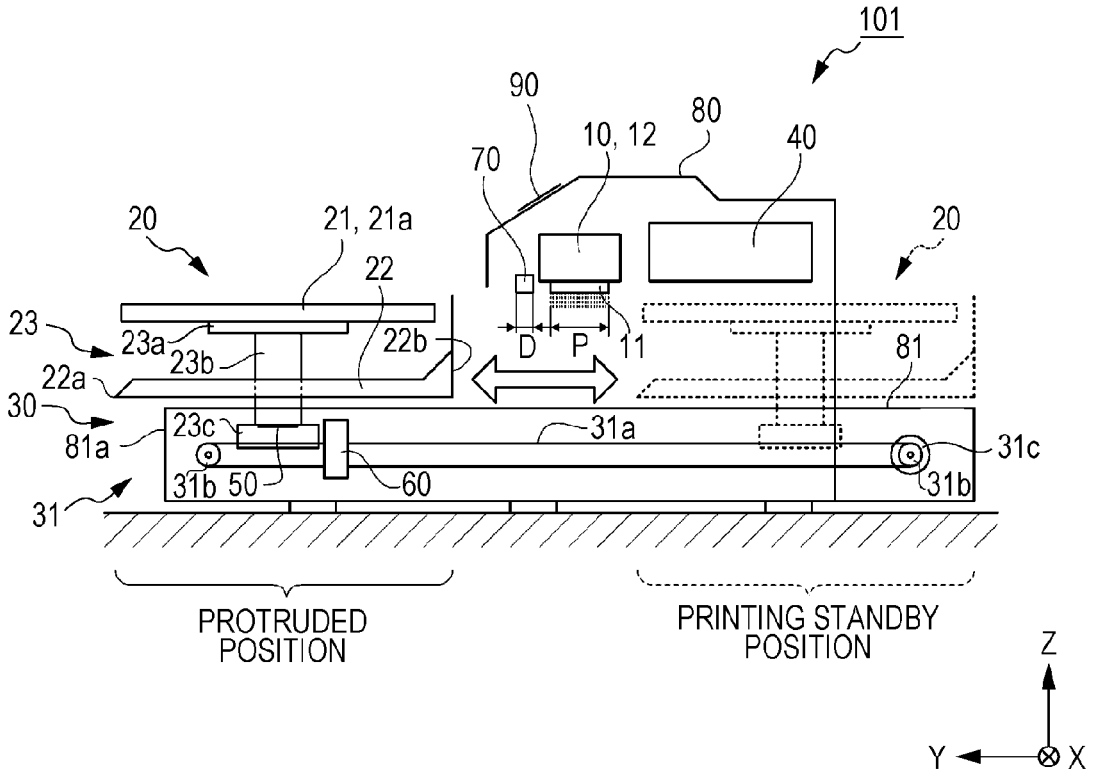
FIG. 5 is a side view of an ink jet type printer as a liquid discharging apparatus according to Modification 1.

FIG. 5 is a side view illustrating a general construction of an ink jet type printer 101 (hereinafter, referred to as "printer 101") as a liquid discharging apparatus according to Modification 1.

Although in Exemplary Embodiment 1, the interfering object detection unit 70 is disposed more to the rear (to the −Y direction side) than the discharge unit 10 as shown in FIG. 2, the interfering object detection unit 70 may instead be disposed more to the front (to the +Y direction side) than the discharge unit 10 as shown in FIG. 5. That is, the interfering object detection unit 70 is disposed to be more to the other direction side than the medium movement unit 20 when the medium movement unit 20 is positioned at the protrusion position. In this case, the position of the medium movement unit 20 that allows a cloth to be set, unlike Exemplary Embodiment 1, is set as a position relative to the interfering object detection unit 70.

Figure 6:
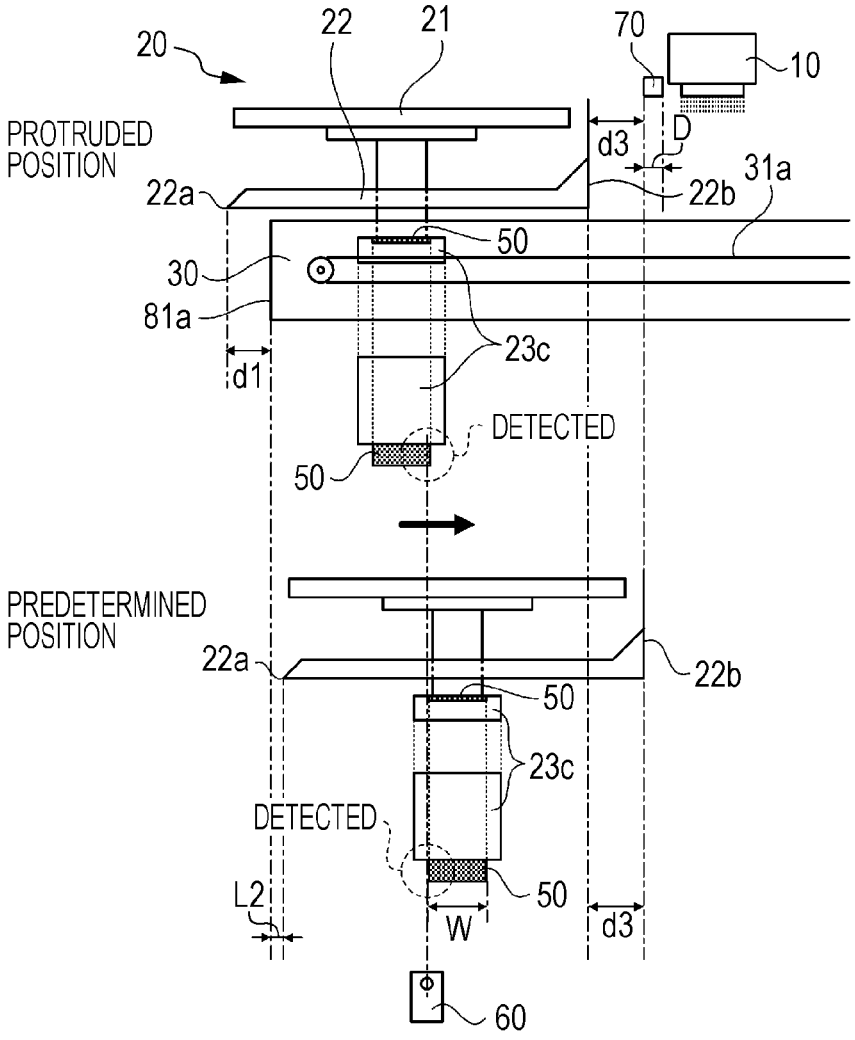
FIG. 6 is an illustrative diagram illustrating positions at which a detected unit and a detector unit in Modification 1 are set.

FIG. 6 is an illustrative diagram illustrating positions (positions on the Y axis) at which the detected unit 50 and the detector unit 60 in the printer 101 are disposed.

The detected unit 50 and the detector unit 60 are disposed so that the detected unit 50 is always detected by the detector unit 60 when the medium movement unit 20 is at the protrusion position at which the one direction-side end portion of the medium movement unit 20 that is at the side in the one direction of the movement directions (at the +Y direction side) (i.e., the +Y direction-side end portion 22*a* of the table 22) protrudes more to the one direction side (+Y direction side) than does the one direction-side (+Y direction-side) end portion of the base unit 30 (i.e., the +Y direction-side end surface 81*a* of the base unit casing 81). Therefore, the detected unit 50 and the detector unit 60 are disposed so that when the medium movement unit 20 is at the farthest position in the +Y direction to which the medium movement unit 20 can be moved (at the position at which the amount of protrusion d1 indicated in an upper portion of FIG. 6 is maximum), the detected unit 50 is within the detection region of the detector unit 60 indicated in a lower portion of FIG. 6.

Furthermore, the detected unit 50 and the detector unit 60 are disposed so that the detected unit 50 is detected by the detector unit 60 when the position of the medium movement unit 20, more concretely, the position of the one direction-side end portion of the medium movement unit 20 that is at the side in the one direction of the movement directions (at the +Y direction side) (i.e., the +Y direction-side end portion 22*a* of the table 22), is in a range between the protrusion position and a position reached by a slight movement from the protrusion position to the other direction side (−Y direction side) (i.e., reached by a slight push-in).

The "position reached by a slight movement from the protrusion position to the other direction side (−Y direction side) (i.e., reached by a slight push-in)" will be described. First, a position at which the one direction-side end portion of the medium movement unit 20 that is at the side in the one direction of the movement directions (at the +Y direction side) (i.e., the +Y direction-side end portion 22*a* of the table 22) is a predetermined distance L apart in the other direction of the movement directions from the one direction-side end portion of the base unit 30 (the end surface 81*a* thereof) is termed the "predetermined position". Then, the "position reached by a slight movement from the protrusion position to the other direction side (−Y direction side) (i.e., reached by a slight push-in)" is a position where the medium movement unit 20 reaches the predetermined position.

This predetermined position is a position where the other direction-side (−Y direction-side) end portion of the medium movement unit 20 (the −Y direction-side end surface 22*b* of the table 22) reaches the interfering object detection region D of the interfering object detection unit 70 as shown in a lower portion of FIG. 6. That is, in Modification 1, the predetermined position of the medium movement unit 20 is a position where the other direction-side end portion of the medium movement unit 20 reaches the detection region where the interfering object detection unit 70 is able to detect an interfering object.

The width W of the detected unit 50 in the Y-axis directions and the detection region of the detector unit 60 are set so that the detected unit 50 is detected by the detector unit 60 when the medium movement unit 20 is within a range between the position at which the amount of protrusion d1 toward the +Y direction side is maximum and the predetermined position reached by a slight movement from the position of the maximum amount of protrusion d1 to the other direction side (−Y direction side) (i.e., reached by a slight push-in). This range is a range where the −Y direction-side end surface 22*b* of the table 22 is moved over a range d3 indicated in FIG. 6, that is, a range where the detector unit 60 detects that the medium movement unit 20 is at a position that allows a cloth to be set on the medium movement unit 20.

Furthermore, the detected unit 50 and the detector unit 60 are disposed so that the detected unit 50 is not detected by the detector unit 60 when the one direction-side end portion of the medium movement unit 20 that is at the side in the one direction of the movement directions (at the +Y direction side) (i.e., the +Y direction-side end portion 22*a* of the table 22) is at a position that is more to the other direction side (−Y direction side) than the predetermined position. That is, the width W of the detected unit 50 in the Y-axis directions and the detection region of the detector unit 60 are set so that when the medium movement unit 20 moves to the other direction side (−Y direction side) of the predetermined position, the detected unit 50 is out of the detection region of the detector unit 60.

Due to this setting, the range of position of the medium movement unit 20 between the protrusion position and the position where the other direction-side (the −Y direction-side) end portion of the medium movement unit 20 (i.e., the −Y direction-side end surface 22*b* of the table 22) reaches the interfering object detection region D where the interfering object detection unit 70 can detect an interfering object can be detected as a position that allows a cloth to be set on (or removed from) the medium movement unit 20.

Incidentally, if a detector unit (second detector unit) similar to the detector unit 60 that is capable of detecting the detected unit 50 is disposed to the −Y direction side of the detector unit 60 and aligned with the detector unit 60 in the Y-axis directions, a construction capable of detecting the position of the medium movement unit 20 relative to, for example, the print start position or the maintenance position, can be built.

The entire disclosure of Japanese Patent Application No. 2014-219028, filed Oct. 28, 2014 is expressly incorporated reference herein.

What is claimed is:

1. A liquid discharging apparatus comprising:

a discharge unit capable of discharging a liquid to a discharge region;

a medium movement unit capable of moving in movement directions while supporting a medium onto which the liquid is discharged;

a base unit that constitutes a movement path along which the medium movement unit moves;

a detected unit; and a detector unit capable of detecting a position of the medium movement unit by detecting the detected unit, wherein the detected unit and the detector unit are disposed so that the detected unit is detected by the detector unit when the medium movement unit is at a protrusion position at which a one direction-side end portion of the medium movement unit which is at a one direction side in the movement directions protrudes more to the one direction side than does a one direction-side end portion of the base unit.

2. The liquid discharging apparatus according to claim 1, wherein the detected unit and the detector unit are disposed so that the detected unit is detected by the detector unit when the medium movement unit is in a range between the protrusion position and a predetermined position at which the one direction-side end portion of the medium movement unit is a predetermined distance apart from the one direction-side end portion of the base unit to an another direction side in the movement directions.

3. The liquid discharging apparatus according to claim 2, wherein the detected unit and the detector unit are disposed so that when the medium movement unit is at a position that is more to the another direction side than the predetermined position, the detected unit is not detected by the detector unit.

4. The liquid discharging apparatus according to claim 2, wherein:

the discharge unit is disposed so as to be more to the another direction side than the medium movement unit when the medium movement unit is positioned at the protrusion position; and the predetermined position is a position at which an another direction-side end portion of the medium movement unit reaches the discharge region.

5. The liquid discharging apparatus according to claim 2, further comprising an interfering object detection unit that detects whether or not an interfering object that interferes with the discharge unit when the medium movement unit moves is present on or at the medium movement unit, wherein the interfering object detection unit is disposed so as to be more to the another direction side than the medium movement unit when the medium movement unit is positioned at the protrusion position, and wherein the predetermined position is a position at which an another direction-side end portion of the medium movement unit reaches a detection region in which the interfering object detection unit is able to detect the interfering object.

6. The liquid discharging apparatus according to claim 1, further comprising a control unit that, when having accepted a predetermined instruction, causes the detector unit to execute a detection operation for detecting the detected unit.

7. The liquid discharging apparatus according to claim 6, wherein if the predetermined instruction is an instruction to turn on a power supply of the liquid discharging apparatus, the control unit causes the detector unit to execute the detection operation, and if the detector unit detects the detected unit, the control unit does not cause the medium movement unit to move.

8. The liquid discharging apparatus according to claim 6, wherein if the predetermined instruction is a print start instruction to start a printing operation that discharges the liquid onto the medium, the control unit causes the detector unit to execute the detection operation, and if the detector unit detects the detected unit, the control unit causes the medium movement unit to move to a print start position at which the printing operation starts.

9. The liquid discharging apparatus according to claim 6, wherein if the predetermined instruction is an instruction to turn off a power supply of the liquid discharging apparatus, the control unit causes the detector unit to execute the detection operation, and if the detector unit detects the detected unit, the control unit turns off the power supply.

10. The liquid discharging apparatus according to claim 6, wherein the control unit causes the detector unit to execute the detection operation, and if the detector unit does not detect the detected unit, the control unit causes the medium movement unit to move to the protrusion position.

* * * * *